US005443356A

United States Patent [19]

Naldi

[11] Patent Number: 5,443,356

[45] Date of Patent: Aug. 22, 1995

[54] AUTOMATIC SLIDE-ON PANEL LOADING SYSTEM

[75] Inventor: Valter Naldi, Via Longo, Italy

[73] Assignee: Selco S.r.l., Crespellano, Italy

[21] Appl. No.: 6,650

[22] Filed: Jan. 21, 1993

[30] Foreign Application Priority Data

Jan. 21, 1992 [IT] Italy ..... B092A 000026

[51] Int. Cl.[6] ..... B65H 3/24

[52] U.S. Cl. ..... 414/790.3; 414/796.8; 271/167

[58] Field of Search ..... 271/137, 167; 414/790.2, 790.3, 795.7, 796.4, 796.8, 796, 796.1

[56] References Cited

U.S. PATENT DOCUMENTS

| | | | |
|---|---|---|---|
| 2,940,617 | 6/1960 | Reed . | |
| 2,963,177 | 12/1960 | Shields | 414/796 |
| 2,988,236 | 6/1961 | Shields | 414/790.3 |
| 3,174,633 | 3/1965 | Stevens . | |
| 3,664,522 | 9/1970 | Goto | 414/796 |
| 3,744,649 | 5/1972 | Ward, Jr. | 414/796 |
| 3,871,642 | 3/1975 | Marioux et al. | 271/167 |
| 4,405,124 | 9/1983 | Watanabe . | |
| 4,653,743 | 3/1987 | Ebata et al. . | |
| 4,714,395 | 12/1987 | Benuzzi et al. | 414/796.8 |
| 5,018,940 | 5/1991 | Hognestad et al. | 414/796.8 |
| 5,044,874 | 9/1991 | Shill | 414/796.8 |
| 5,135,213 | 8/1992 | Malachowski et al. | 271/167 |
| 5,205,703 | 4/1993 | Shill et al. | 414/796.8 |

FOREIGN PATENT DOCUMENTS

| | | | |
|---|---|---|---|
| 317370 | 5/1918 | Germany . | |
| 2433128 | 1/1976 | Germany . | |
| 3008156 | 10/1980 | Germany . | |
| 3619676 | 12/1987 | Germany . | |
| 47738 | 3/1983 | Japan | 271/137 |

*Primary Examiner*—Michael S. Huppert
*Assistant Examiner*—Gregory A. Morse
*Attorney, Agent, or Firm*—Michael N. Meller

[57] ABSTRACT

A system having a stack of panels from which a pack of any given height may be removed, a work station having a supporting surface, a transfer bar for feeding the pack onto the supporting surface using at least one push member, and an arresting assembly for arresting the panels underlying the pack which tend to slip towards the supporting surface when the pack is fed by the transfer bar. The arresting assembly comprises at least one body installed between the stack and the supporting face for arresting the panels underlying the pack, an actuator for pushing the body against the bottom of the moving pack, and sensing means for detecting movement of the pack to a given point, and for activating the actuator so as to bring the body into contact with the bottom edge of the pack.

8 Claims, 2 Drawing Sheets

AUTOMATIC SLIDE-ON PANEL LOADING SYSTEM

BACKGROUND OF THE INVENTION

The present invention relates to a slide-on system for automatically loading panels of wood, plastic or similar material, and which is especially suitable for applications involving thin, undulated panels.

Known slide-on panel loading systems feature a transfer bar with push members by which a pack of panels is pushed off the top of a stack into the work station. Particularly when loading thin, undulated panels, one or more panels underneath the pack being loaded invariably inch forward in the direction of the work station, due to friction between the underside of the bottom panel in the moving pack and the top surface of the panel underneath, which friction is further accentuated by the weight of the moving pack and the undulated design of the panels. Slippage of the underlying panels not forming part of the pack for loading creates serious problems by virtue of the offset position assumed by the underlying panels in relation to the moving pack. This invariably results in handling and aligning problems when loading the next pack, and very often in high-cost machine stoppages for restoring acceptable loading conditions. U.S. Pat. No. 3,841,642 describes a sheet feeding apparatus for feeding stiff curved sheets one at a time from a vertical stack of such sheets to a sheet processing machine. This apparatus has a gate to permit passage of one sheet at a time and cannot be used in cutting a pack of panels. In fact, it is intended for use in machines which can cut one sheet at a time. U.S. Pat. No. 5,018,940 describes an apparatus for separating one or more essentially thin and planar products from a stack of such products. In this apparatus, the thickness of a gate through which the products pass is predetermined. The apparatus includes a sensor which singles out the level of the products and which controls the level of the gate which has always the same thickness. The apparatus cannot be used to feed panels of wood because it presents bodies which press on the pack during the movement, making possible scratches on the surface of the panels. Furthermore, this apparatus is not predisposed to move packs of thickness greater than the thickness of the gate. Lastly, in this apparatus, the gate could interfere with the passage of packs formed by undulated panels which could get in touch with the edges of such gate.

SUMMARY OF THE INVENTION

It is an object of the present invention to provide an automatic slide-on panel loading system designed to overcome the aforementioned drawbacks, i.e. designed to prevent slippage of the panels underlying the moving pack being loaded.

Further aims and advantages of the present invention will be disclosed in the following description.

The automatic slide-on panel loading system of the present invention comprises:

- a vertical stack (3) of panels (2) from which a pack (12) representing any selected number of panels from the top of the stack may be removed;
- a work station having a supporting surface (13);
- a transfer bar (6) including a push member (11) for feeding said pack (12) onto said supporting surface (13); and
- an arresting assembly (14) for arresting the panels in said stack underlying said pack to prevent slippage of the remaining panels in said stack when said pack is fed by said transfer bar, said arresting assembly comprising at least one body (15) disposed between said stack and said supporting surface (13); movable push means for pushing said body (15) into direct contact with the bottom panel in said pack as it moves toward said supporting surface and sensing means for activating said movable push means in response to the movement of said pack over a predetermined distance.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
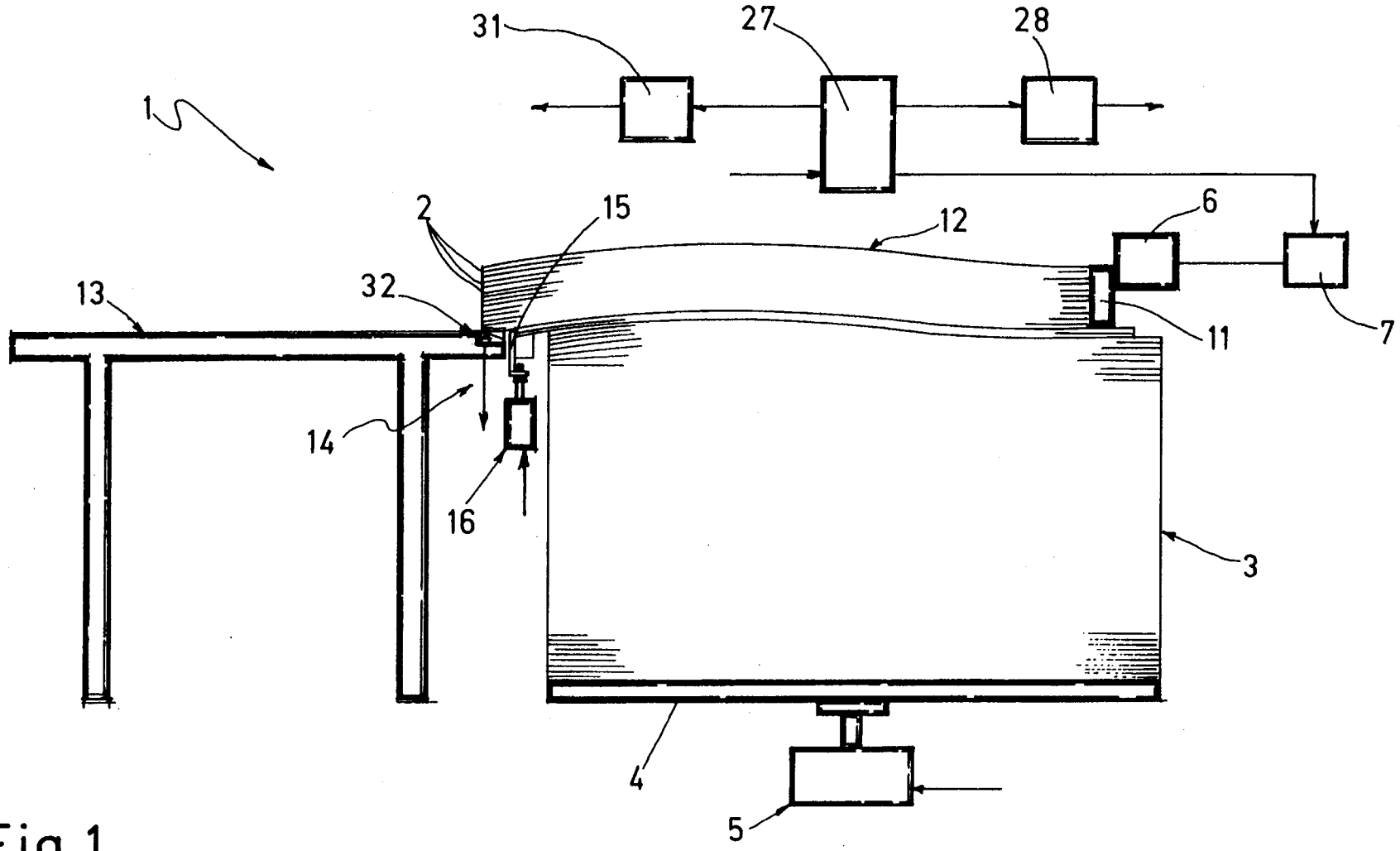
FIG. 1 shows a side view of an automatic slide-on panel loading system.
Figure 2:
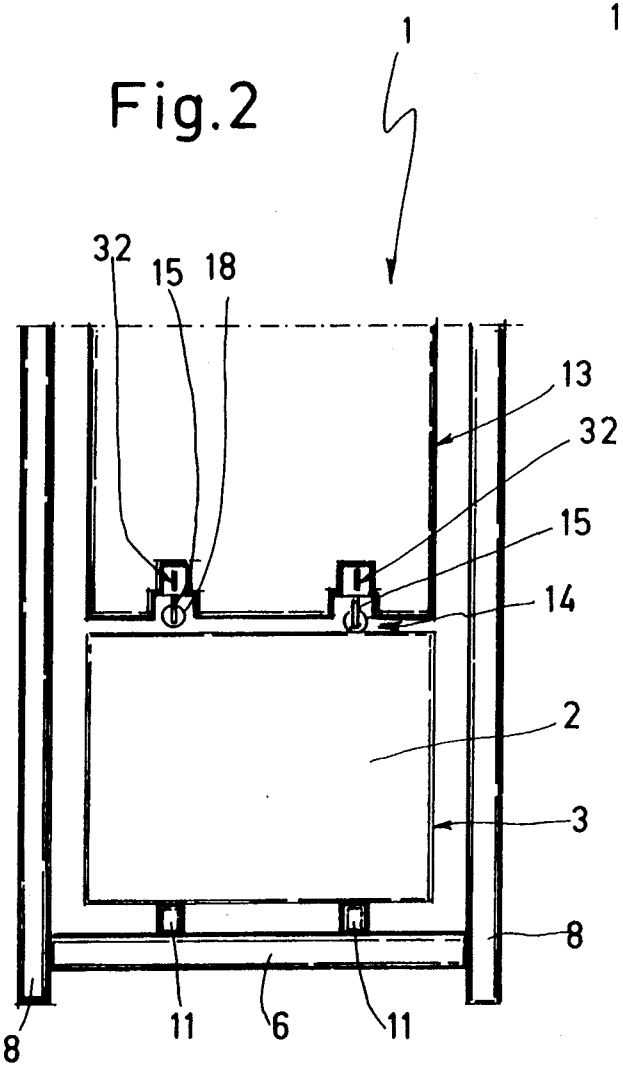
FIG. 2 shows a plan view of the FIG. 1 system.

Number 1 in FIGS. 1 and 2 indicates a slide-on system for automatically loading panels 2 arranged in a stack 3 on a platform 4 moved parallel to itself by a fluid actuator 5. System 1 also comprises a bar 6 moved parallel to itself by an electric motor 7 connected to bar 6 in known manner and therefore shown only schematically. The ends of bar 6 slide along respective slideways 8, and, on the side facing stack 3, bar 6 presents two push members 11 which, as bar 6 moves forward, push a pack 12 of panels 2 on to the supporting surface 13 of a work station featuring production machines (not shown). The height of platform 4 and therefore of the top panel 2 in stack 3 determines the height of, and therefore the number of panels 2 in, pack 12.

Figure 3:
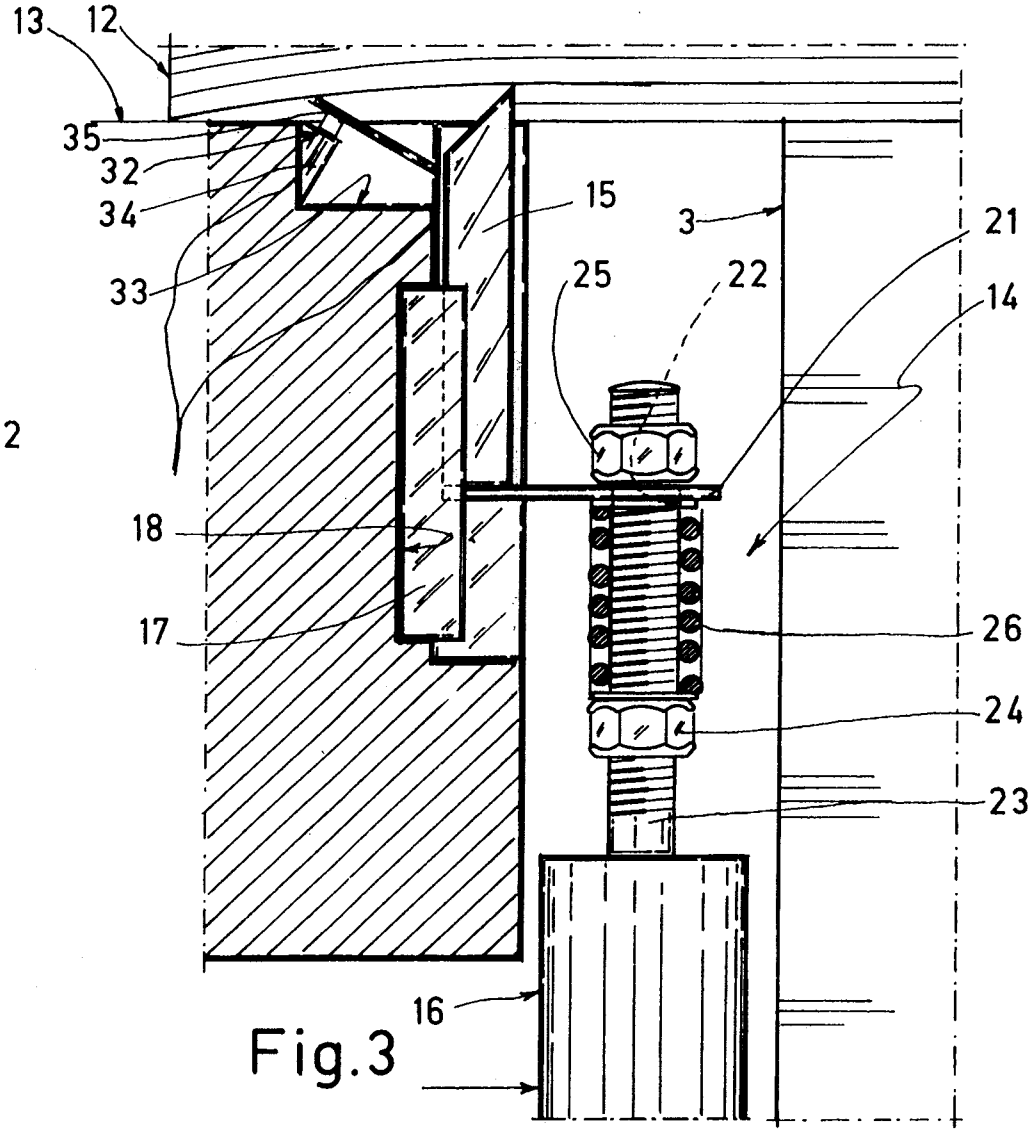
FIG. 3 shows a larger-scale, partially sectioned view of a detail in the FIG. 1 system.

With reference to FIGS. 1 and 3, as pack 12 is loaded on to surface 13, one or more panels 2 underneath pack 12 also inch towards surface 13, due to friction between the underside of the bottom panel 2 in the moving pack 12 and the underlying panel 2, which friction is further accentuated by the weight of the moving pack 12 and the undulated design of panels 2. To overcome the above drawback, and the problems resulting from it and described previously, system 1 comprises, between surface 13 and stack 3, a device 14 for arresting the panels 2 underlying pack 12 and which tend to inch towards surface 13. Device 14 comprises two parallel vertical plates 15 positioned a given distance apart and each connected to a respective fluid actuator 16. At the top end, each plate 15 presents a tapered tip having a vertical face on the side facing stack 3, and an oblique face on the side facing surface 13. Each plate 15 is movable vertically along a respective. slideway 17 housed inside a recess 18 (FIG. 3) formed along the lateral edge of supporting surface 13 facing stack 3.

At the bottom end, each plate 15 is mechanically integral with, e.g. welded to, a respective horizontal plate 21, which, on the opposite side to that connected mechanically to plate 15, presents a vertical through hole 22. Each actuator 16 presents a vertical threaded rod 23 fitted firstly with a nut 24, then itself fitted through hole 22 in plate 21, and finally fitted with a second nut 25. Between nut 24 and plate 21, a preloaded helical spring 26 is wound about rod 23, and which provides for pressing plate 21 on to nut 25 and so pushing plate 15 upwards.

With reference to FIG. 1, system 1 presents an electronic control system 27 for controlling actuators 5 and 16 via respective fluid systems 28 and 31 (shown schematically), as well as for controlling motor 7. In other words, control system 27 provides for controlling translation of platform 4, bar 6 and plates 15. Two sensors 32, one for each plate 15, are connected to control system 27 for signaling to system 27 the passage of pack 12 over the gap housing device 14.

In the FIG. 3 embodiment, each sensor 32 consists of a microswitch housed in a recess 33 formed in the top face of supporting surface 13, over recess 18. Each microswitch presents a fixed blade 34 inside recess 33 and in which is defined a first electrical contact; and a flexible blade 35 extending upwards beyond the top face of supporting surface 13, and in which is defined a second electrical contact. In the example shown, sensors 32 signal to system 27 the arrival of pack 12 on to supporting surface 13, by virtue of the weight of pack 12 flexing blade 35 inwards of recess 33 and so connecting the two electrical contacts of the microswitch.

In actual use, at the start of the loading cycle, rods 23 of actuators 16 are set to the bottom limit position, so that the tip of plates 15 does not extend beyond the top face of supporting surface 13; and, having determined the height of pack 12 for loading, bar 6 is moved towards supporting surface 13. The height of pack 12 is determined by adjusting the height of platform 4, or, if push members 11 are equipped with a manual or automatic height adjusting device, by adjusting the height of push members 11 in relation to bar 6. Systems are also available on the market for determining the height of pack 12 by adjusting the height of both platform 4 and push members 11. On reaching the edge of supporting surface 13, pack 12 activates sensors 32, which, via control system 27, operate actuators 16 so as to raise rods 23 and, via springs 26, also plates 15, and so that the tips of plates 15 contact the bottom panel 2 in the moving pack 12. The upward travel of rods 23 may be regulated by control system 27 as a function of the height of pack 12. The tips of plates 15 remain permanently contacting bottom panel 2 in the moving pack 12, by virtue of the pressure exerted on the respective plate 15-plate 21 assemblies by springs 26, which thus act as dampers for counteracting any vertical displacement of plates 15 caused by the undulated design of the moving pack 12. The panels 2 underneath the moving pack 12, and which tend to inch towards supporting surface 13, are permitted only a small amount of displacement and so prevented from sliding on to surface 13, by virtue of contacting and being arrested by the vertical portion of plates 15. Upon pack 12 clearing recess 33, blades 35 spring back to the original position, thus de-activating sensors 32; and control system 27 lowers rods 23 and, consequently, plates 15, for loading the next pack 12.

Between one loading cycle and the next, plates 15 may also be used for aligning panels 2 in the next pack 12, by increasing the upward travel of rods 23 and, consequently, plates 15 as compared with that required for contacting the bottom panel 2 in the moving pack 12, and by moving bar 6 just enough to align all the panels 2 in the new pack 12 against plates 15. At this point, control system 27 lowers rods 23 and moves bar 6 towards supporting surface 13; and, upon pack 12 activating sensors 32, rods 23 are raised, so that plates 15 arrest the panels 2 underneath pack 12 and which tend to inch towards supporting surface 13.

The advantages of the present invention will be clear from the foregoing description.

In particular, it provides for preventing the panels underneath the moving pack from inching towards the work station, thus enabling troublefree handling and alignment of the panels in subsequent packs, with no machine stoppages required. The device for arresting the underlying panels remains permanently contacting the bottom edge of the moving pack by means of pressure exerted on the bottom edge throughout the loading stage, thus ensuring effective arrest of the underlying panels throughout the loading operation. As already stated, the panel arrester may also be used for aligning the panels in the next pack. Further points to note are the straightforward design and, hence, low production cost of the system according to the present invention, and that fact that it may be applied to existing plants with no major alterations required.

To those skilled in the art it will be clear that changes may be made to system 1 as described and illustrated herein without, however, departing from the scope of the present invention.

In particular, push members 11 may be designed differently from those described herein, and may, for example, be known types in the form of an articulated quadrilateral, or feature grips for gripping pack 12. The height of pack 12 may be determined using methods other than those described or mentioned by way of alternatives herein. Panel arrestor 14 may present one or more plates 15, which in turn may be shaped differently from those described herein. For example, device 14 may present a single central plate 15 with a large-area stop face. Changes may also be made to the manner in which the tip of plate 15 is maintained permanently contacting the bottom edge of pack 12. For example, provision may be made for a spring acting directly on plate 15, or the functions of spring 26 may be performed by actuator 16 of device 14 itself. In place of actuators 16, device 14 may present, for example, an electric motor or lever mechanism for operating plate 15. The passage of pack 12 on to supporting surface 13 may be detected by sensors other than those described herein, e.g. optical, proximity or pressure sensors. Finally, changes may also be made to the location of sensors 32, which may, for example, be fitted to the tip of plate 15, the upward movement of which may be effected, not by sensors, but after a given operating time of bar 6.

I claim:

1. An automatic slide-on panel loading system of the present invention comprising:

a vertical stack (3) of panels (2) from which a pack (12) representing any selected number of panels from the top of the stack may be removed;

a work station having a supporting surface (13);

a transfer bar (6) including a push member (11) for feeding said pack (12) onto said supporting surface (13); and an arresting assembly (14) for arresting the panels in said stack underlying said pack to prevent slippage of the remaining panels in said stack when said pack is fed by said transfer bar, said arresting assembly comprising at least one body (15) disposed between said stack and said supporting surface (13), movable push means (16) for pushing said body (15) into direct contact with the bottom panel in said pack as it moves toward said supporting surface and sensing means for activating said movable push means in response to the movement of said pack over a predetermined distance, wherein said sensing means comprises at least one microswitch (32) having a fixed blade (34) housed inside a recess (33) in the top face of said supporting surface (13) and in which is defined a first electric contact, and a flexible blade (35) extending upwards beyond the top face of said supporting surface (13) and in which is defined a second electric contact, said pack (12) on being fed on the said supporting surface (13), pressing said flexible blade (35) on the said fixed blade (34) and so electrically contacting the same.

2. A system as claimed in claim 1, wherein said arresting assembly (14) further comprises means (26) enabling relative movement of said body (15) and said push means (16) so that a portion of said body (15) contacts the bottom edge of said pack (12) adjacent said stack; and remains in contact with said bottom edge even if this is undulated.

3. A system as claimed in claim 2, further comprising an electronic control system (27) for controlling operation of said bar (6) and said push means (16) to which said sensing means (32) is connected.

4. A system as claimed in claim 3, further comprising a platform (4) for supporting said stack (3), and means (5) enabled by said control system (27) for moving said platform (4).

5. A system as claimed in claim 1, wherein said push means comprises a fluid actuator (16) having a vertical rod (23) fitted with said body (15).

6. A system as claimed in claim 5, wherein said body (15) is free to move in relation to said rod (23), and said rod (23) is fitted with elastic means (26) for pushing said body (15) upwards.

7. A system as claimed in claim 6, wherein said body comprises a vertical plate (15) having at the top end, a tapered tip defined by a vertical face on the side facing said supporting surface (13), said plate (15) being movable vertically along a slideway (17) housed inside a recess (18) formed along the lateral edge of said supporting surface (13) facing said stack (3).

8. A system as claimed in claim 1, wherein said arresting assembly comprises two of said bodies (15) located a given distance apart with each body connected to a respective push means (16).

* * * * *